US011784389B2

(12) United States Patent
Liu et al.

(10) Patent No.: US 11,784,389 B2
(45) Date of Patent: Oct. 10, 2023

(54) MOUNTING DEVICE AND BASE STATION ANTENNA SYSTEM AND MOUNTING METHOD

(71) Applicant: CommScope Technologies LLC, Hickory, NC (US)

(72) Inventors: Maosheng Liu, Jiangsu (CN); PuLiang Tang, Jiangsu (CN); Zhaohui Liu, Jiangsu (CN); Ruixin Su, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 120 days.

(21) Appl. No.: 17/369,195

(22) Filed: Jul. 7, 2021

(65) Prior Publication Data

US 2022/0037759 A1 Feb. 3, 2022

(30) Foreign Application Priority Data

Jul. 29, 2020 (CN) ..... 202010740945.2

(51) Int. Cl.
*H01Q 1/12* (2006.01)
*H01Q 1/24* (2006.01)

(52) U.S. Cl.
CPC ..... *H01Q 1/1228* (2013.01); *H01Q 1/12* (2013.01); *H01Q 1/1207* (2013.01); *H01Q 1/24* (2013.01); *H01Q 1/246* (2013.01)

(58) Field of Classification Search
CPC ..... H01Q 1/1228; H01Q 1/246; H01Q 1/12; H01Q 1/1207; H01Q 1/24
(Continued)

(56) References Cited

U.S. PATENT DOCUMENTS

2014/0179244 A1* 6/2014 Colapietro ..... H01Q 1/246 455/90.2
2014/0315408 A1 10/2014 Colapietro et al.
(Continued)

FOREIGN PATENT DOCUMENTS

| | | |
|---|---|---|
| EP | 2747194 | 6/2014 |
| EP | 3113284 | 1/2017 |
| WO | 2018022307 A1 | 2/2018 |

OTHER PUBLICATIONS

"Extended European Search Report corresponding to European Application No. 21187889.7 dated Dec. 16, 2021".

*Primary Examiner* — Hai V Tran
(74) *Attorney, Agent, or Firm* — Myers Bigel, P.A.

(57) ABSTRACT

The invention relates to a mounting device for mounting a remote radio unit (2) to a base station antenna (1) and relates to a base station antenna system formed thereby. The mounting device includes a support base (6) configured to be mounted to the base station antenna and to support the remote radio unit; a support element configured to be mounted to the remote radio unit and movable together with the remote radio unit between a first position, in which the support element is lifted from the support base, and a second position, in which the support element is supported on the support base; a plug arrangement including a plug element and a socket element, one of which is configured to be mounted to the base station antenna, and the other of which is configured to be mounted to the remote radio unit, wherein in the first position, the plug element and the socket element are separated from each other, and in the second position, the plug element and the socket element are engaged with each other.

18 Claims, 8 Drawing Sheets

(58) Field of Classification Search
USPC ..... 343/702
See application file for complete search history.

(56) References Cited

U.S. PATENT DOCUMENTS

| | | | | |
|---|---|---|---|---|
| 2016/0153609 | A1* | 6/2016 | Ortel | A47B 81/06 211/26 |
| 2016/0261030 | A1* | 9/2016 | Kim | H01Q 1/1264 |
| 2016/0365618 | A1* | 12/2016 | Kim | H01Q 1/1242 |
| 2017/0149115 | A1 | 5/2017 | Sierzenga et al. | |
| 2017/0237160 | A1* | 8/2017 | Kim | B64G 1/66 343/745 |

* cited by examiner

MOUNTING DEVICE AND BASE STATION ANTENNA SYSTEM AND MOUNTING METHOD

RELATED APPLICATION

The present application claims priority from and the benefit of Chinese Patent Application No. 202010740945.2, filed Jul. 29, 2020, the disclosure of which is hereby incorporated herein by reference in full.

FIELD OF THE INVENTION

The disclosure relates to the field of base station antennas, and more particularly, relates to a mounting device and a mounting method for mounting a remote radio unit (RRU) to a base station antenna (BSA), and relates to a base station antenna system.

BACKGROUND OF THE INVENTION

In a wireless communication network, a BSA may be provided with a RRU, and they may be electrically connected with each other through jumper lines. Typically, a BSA and a RRU may be separately mounted on different poles, so both the BSA and the RRU need separate mounting spaces. A relative position of the BSA and the RRU may only be determined at a mounting location, so a length of the jumper lines for electrically connecting the BSA and the RRU may not be pre-determined. For some BSA, a RRU may be mounted thereon, so the mounting space may be saved. However, the mounting of the RRU on the BSA may be difficult. With regard to related prior art, reference may be made to the publication documents US20170149115A1 and WO2018022307A1, which have disclosed a combination of a BSA and a RRU, respectively.

SUMMARY OF INVENTION

An object of the disclosure is to provide a mounting device and a mounting method for mounting a RRU to a BSA and to provide a BSA system formed by means of the mounting device, wherein the mounting device may realize easy and accurate mounting of the RRU to the BSA.

According to a first aspect of the invention, there is proposed a mounting device for mounting a RRU to a BSA, the mounting device including:

- a support base configured to be mounted to the BSA and to support the RRU;
- a support element configured to be mounted to the RRU and movable together with the RRU between a first position, in which it is lifted from the support base, and a second position, in which it is supported on the support base, in a mounted state of the support element to the RRU; and
- a plug arrangement including a plug element and a socket element, one of which is configured to be mounted to the BSA, and the other of which is configured to be mounted to the RRU.

During a mounting process by means of such a mounting device, the RRU may be accurately positioned on the BSA by simple operation steps, wherein the RRU may be placed in the first position at first, and then the RRU may be moved to the second position under gravity.

In the case that the RRU and the support base have matched RF connectors, they may be plugged in a blind manner, and an electrical connection may be automatically formed in the second position.

In some embodiments, the mounting device may include a pin-hole connection, which may include a pin and a hole, wherein one of the pin and the hole may be assigned to the RRU and the other of the pin and the hole may be assigned to the support base. By means of the pin-hole connection, the positioning reliability of the RRU may be improved in a mounting process of the RRU.

In some embodiments, the plug arrangement and the pin-hole connection may be configured to linearly and translationally guide the RRU between the first position and the second position.

In some embodiments, the RRU can move in a longitudinal direction of the BSA between the first position and the second position.

In some embodiments, the plug element and the socket element may have complementary cross-sections. For example, they may have a T-shaped cross-section.

In some embodiments, the plug element may be arranged on the RRU, and the socket element may be arranged in the BSA. It will be appreciated that an opposite arrangement may also be possible.

In some embodiments, the mounting device may include a mounting frame configured to be mounted to the BSA.

In some embodiments, the mounting frame may include two longitudinal beams that are parallel to each other and that may have respective notches and respective guide grooves as the socket elements, the guide grooves extending along a longitudinal direction of the longitudinal beams, wherein in the first position, two plug elements can be introduced into the respective guide grooves through the respective notches, and then can move along the respective guide grooves into the second position.

In some embodiments, the mounting device may include a first adapter plate having the two plug elements, the first adapter plate being configured to be mounted to the RRU.

In some embodiments, the first adapter plate may have a body and the two plug elements transversely protruding from the body.

In some embodiments, the support base may have a receptacle on which the support element can be supported in the second position.

In some embodiments, the receptacle may have a groove extending transversely, in which the support element is supported and received in the second position.

In some embodiments, the receptacle may have an edge extending transversely, and the support element may have a groove extending transversely, in which the support element receives the edge of the receptacle in the second position.

In some embodiments, the support element may be configured as a second adapter plate, which includes a body for planar abutting on the RRU and fixed on the RRU, and a support section extending from the body.

In some embodiments, the first adapter plate and the second adapter plate may be separate parts from each other or may be an integral part.

In some embodiments, the support section may be supported and received in the groove of the receptacle in the second position.

In some embodiments, the second adapter plate may have a recess in which the receptacle is received in the second position, such that the second adapter plate is transversely positioned by the receptacle.

In some embodiments, the mounting device may include a mounting strip configured to be transversely mounted to the BSA and having at least one first guide groove, for example two first guide grooves that are parallel to each other and are spaced apart from each other, as the socket element.

In some embodiments, the first guide groove may extend in a longitudinal direction of the BSA when the mounting strip is mounted to the BSA.

In some embodiments, the mounting device may include at least one plug strip, for example two plug strips that are parallel to each other and are configured to be mounted to the RRU, as the plug element.

In some embodiments, the support base may have at least one second guide groove, for example two second guide grooves that are parallel to each other and are spaced apart from each other.

In some embodiments, the second guide groove may extend in a longitudinal direction of the BSA in a mounting state of the support base to the BSA.

In some embodiments, the mounting device may include at least one second plug strip, for example two second plug strips that are parallel to each other and are to be mounted to the RRU, as the support element.

In some embodiments, in the first position, the second plug strip and the second guide groove may be separated from each other, and in the second position, the second plug strip may be engaged with the second guide groove and is supported on the support base.

In some embodiments, the first plug strip and the second plug strip may be configured identically or differently.

In some embodiments, the mounting device may include a locking device configured to lock the RRU on the BSA in the second position.

In some embodiments, each longitudinal beam may be provided with a locking device, which includes a nut received in the longitudinal beam in a rotation-resistant manner, a screw rod engaged with the nut, and a grip for rotating the screw rod, wherein the nut and the plug element associated with the longitudinal beam have matched inclined surfaces.

In some embodiments, each first guide groove may be provided with a first locking device, which may be configured to lock the first plug strip plugged into the first guide groove.

In some embodiments, each second guide groove may be provided with a second locking device, which may be configured to lock the second plug strip plugged into the second guide groove.

In some embodiments, the first plug strip and the second plug strip may be configured identically, similarly or differently.

In some embodiments, the first locking device and the second locking device may be configured identically, similarly or differently.

In some embodiments, the support base may have a plurality of RF connectors configured to be electrically connected with the BSA and electrically connected with RF connectors of the RRU in the second position.

According to a second aspect of the invention, a BSA system is proposed, which includes a BSA and a RRU, and a mounting device for mounting the RRU to the BSA according to the first aspect of the invention.

In some embodiments, the BSA and the RRU may be pre-assembled by means of the mounting device and then mounted to a pole as a structural unit.

In some embodiments, the BSA may be first mounted to a pole, and then the RRU may be mounted to the BSA by means of the mounting device.

According to a third aspect of the invention, a mounting method for mounting a remote radio unit to a base station antenna is proposed, including following steps:

mounting a support base to the base station antenna, and mounting a support element to the remote radio unit, mounting one of a plug element and a socket element of a plug arrangement to the base station antenna, and mounting the other of the plug element and the socket element to the remote radio unit;

moving the remote radio unit to a first position relative to the base station antenna, in which first position the plug element and the socket element to be engaged with each other are aligned with each other and the support element is lifted from the support base, and moving the remote radio unit to a second position relative to the base station antenna from the first position, in which second position the support element is supported on the support base and the plug element and the socket element are engaged with each other.

In some embodiments, the mounting method may be further characterized by aligning a pin and a hole of a pin-hole connection in the first position, wherein one of the pin and the hole is assigned to the remote radio unit, and the other of the pin and the hole is assigned to the support base, wherein the pin-hole connection positions the remote radio unit during movement of the remote radio unit relative to the base station antenna from the first position to the second position.

In some embodiments, the mounting method may use the mounting device according to the first aspect of the invention.

Above-mentioned technical features, technical features to be mentioned below and technical features obtained in the drawings may be arbitrarily combined with each other as long as they are not contradictory. All technically feasible feature combinations are technical contents contained in the disclosure.

BRIEF DESCRIPTION OF THE DRAWINGS

The invention will be described in detail below by means of embodiments with reference to the accompanying drawings. Among them.

EMBODIMENTS

Figure 1:
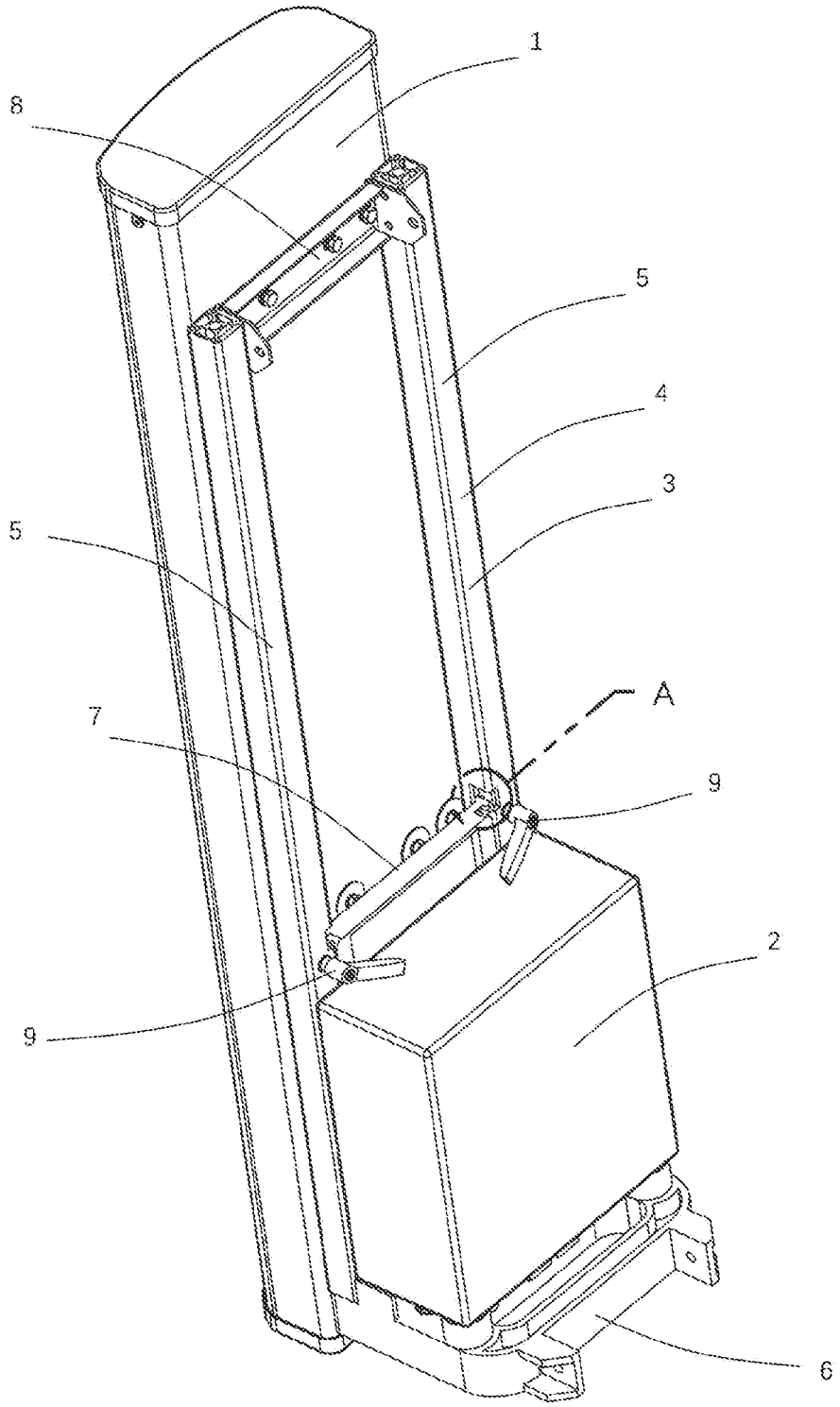
FIG. 1 and FIG. 2 are perspective views of a BSA system according to an embodiment of the present invention, wherein raised and lowered positions of a RRU are illustrated.
Figure 2:
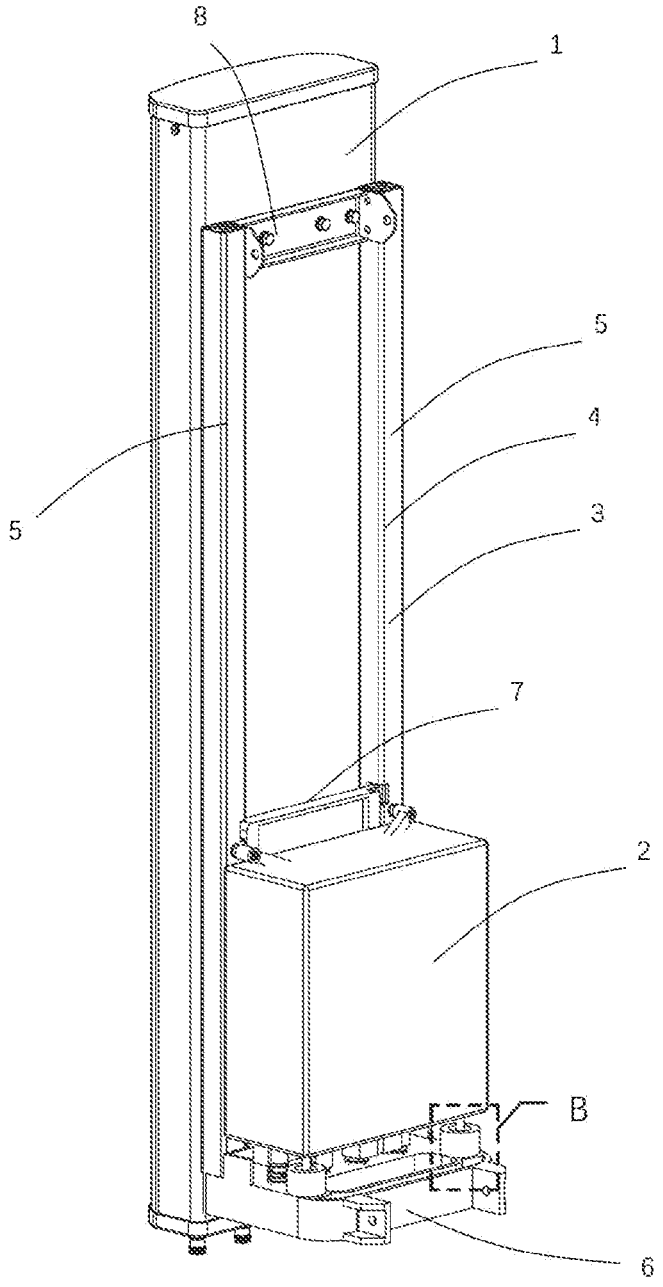
Figure 3:
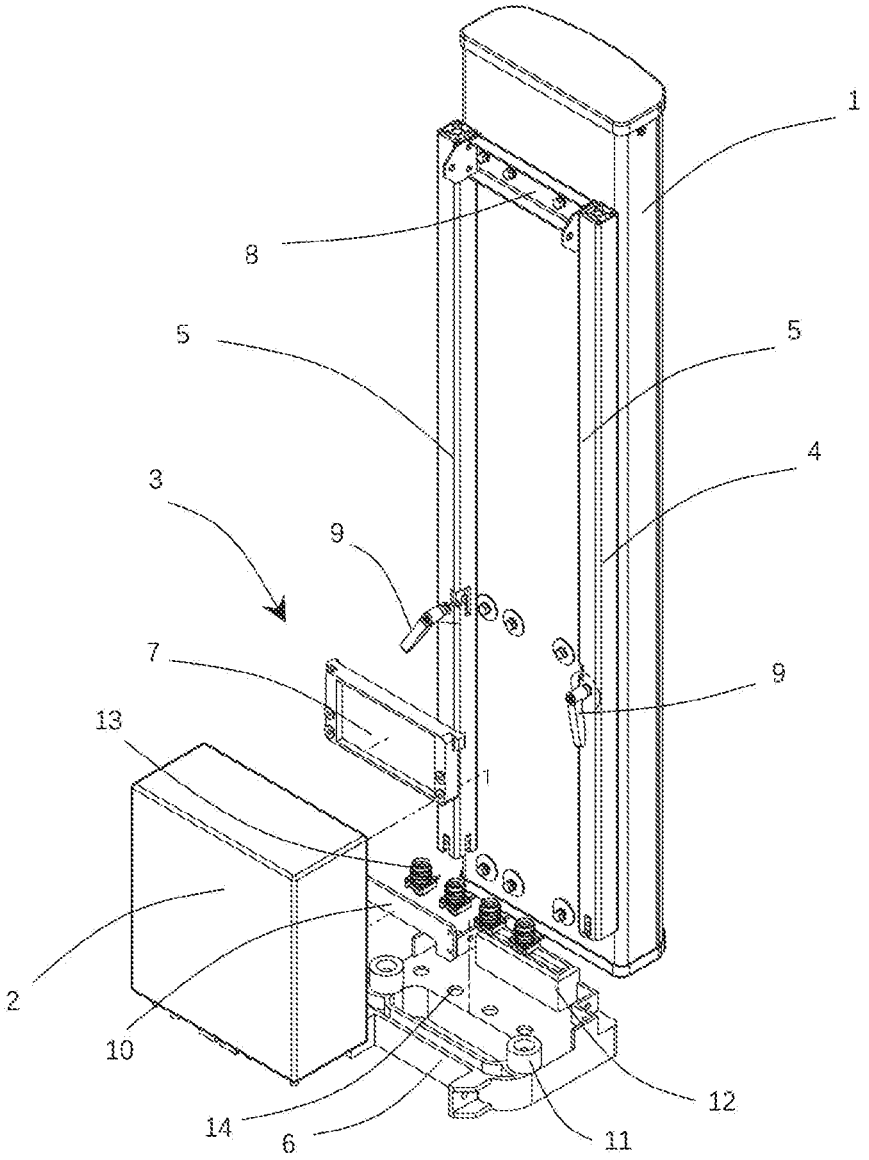
FIG. 3 is an exploded view of the BSA system of FIG. 1.

FIG. 1 and FIG. 2 are perspective views of a BSA system according to an embodiment of the invention in different positions of a RRU, and FIG. 3 is an exploded view of the BSA system of FIG. 1. The BSA system includes a BSA 1 and the RRU 2, wherein the RRU 2 may be mounted to the BSA 1 by means of a mounting device 3.

The mounting device 3 may include a support base 6 configured to be mounted to the BSA 1 and to support the RRU 2. In a lowered state shown in FIG. 1, the RRU 2 is supported on the support base 6, i.e. in a second position. In a raised state shown in FIG. 2, the RRU 2 is lifted from the support base 6, i.e. in a first position. In an unlocked state, the RRU 2 can move between the first position and the second position, for example, it can move linearly in a longitudinal direction of the BSA 1.

Figure 6A:
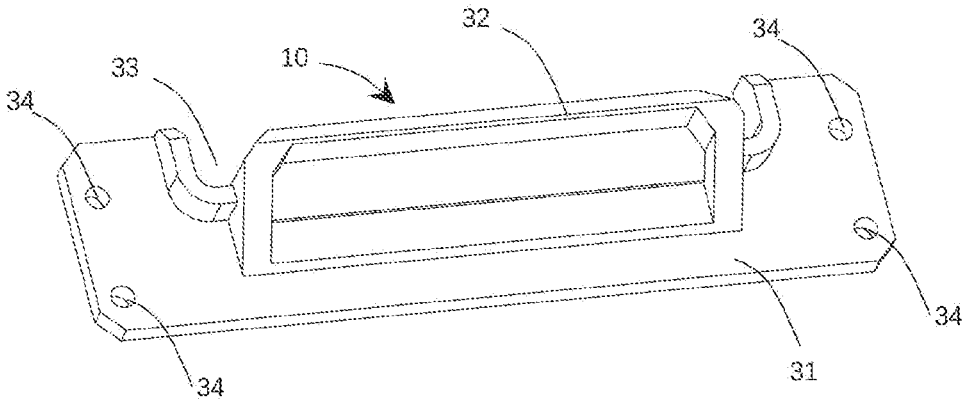
FIG. 6A is a perspective view of a support element of the mounting device of the BSA system of FIG. 1.
Figure 6B:
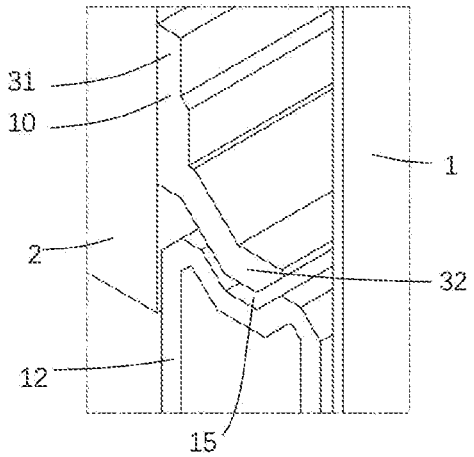
FIG. 6B is a partial sectional view of the BSA system of FIG. 1 taken along a longitudinal center plane of the BSA.

The mounting device 3 may include a support element 10 (see FIG. 3 and FIGS. 6A, 6B) configured to be mounted to the RRU 2 and movable together with the RRU 2 between the first position, in which the support element 10 is lifted from the support base, and the second position, in which the support element 10 is supported on the support base 6. The support element 10 may be configured as an adapter plate, which may include a body 31 for planar abutting on the RRU 2 and fixed on the RRU, and a support section 32 extending from the body 31. The support base 6 may have a receptacle 12 on which the support element 10 can be supported in the second position. The receptacle 12 may have a transversely extending groove 15 in which the support element 10 may be supported and received with its support section 32 in the second position. The support element 10 may have a recess 33 in which the receptacle 12 is received in the second position, so that the support element 10 is transversely positioned by the receptacle 12. The support element 10 may be fixed to the RRU 2 by means of screws, for example. To this end, for example, a plurality of screw holes 34 may be provided in the body 31 of the support element 10 (see FIG. 6A).

The mounting device 3 may include a plug arrangement which may include a plug element and a socket element, one of which is configured to be mounted to the BSA, and the other of which is configured to be mounted to the RRU. In the embodiment shown in FIGS. 1 to 3, the mounting device 3 may include an adapter plate 7, which may be configured to be mounted to the RRU 2. The adapter plate may have a body 22 and the two plug elements 23 transversely extending from the body 22. The two plug elements may be plugged into the respective two socket elements of the BSA 1. The plug element and the socket element may have complementary cross-sections. In the embodiment shown in FIGS. 1 to 3, the mounting device 3 may include a mounting frame 4 configured to be mounted to the BSA 1 and having two longitudinal beams 5 parallel to each other. The longitudinal beams 5 have respective notches 21 and respective guide grooves as the socket elements which extend in a longitudinal direction of the longitudinal beams, wherein in the first position, the two plug elements 23 can be introduced into the respective guide grooves through the respective notches 21 and then can be moved along the respective guide grooves into the second position. The adapter plate 7 and the support element 10 may be two separate parts or an integral part.

Figure 4A:
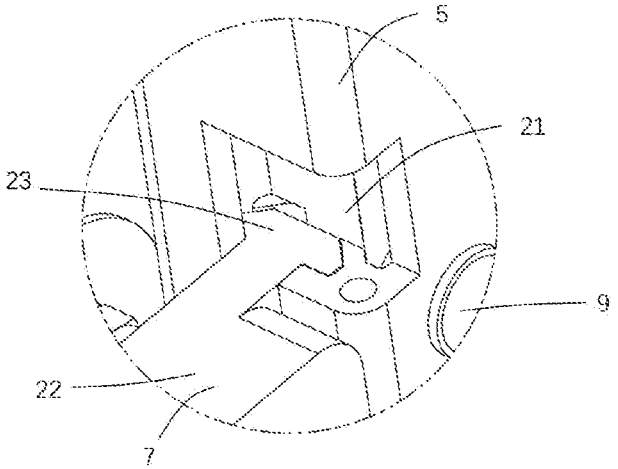
FIGS. 4A to 4E are detailed views of the BSA system of FIG. 1.
Figure 4B:
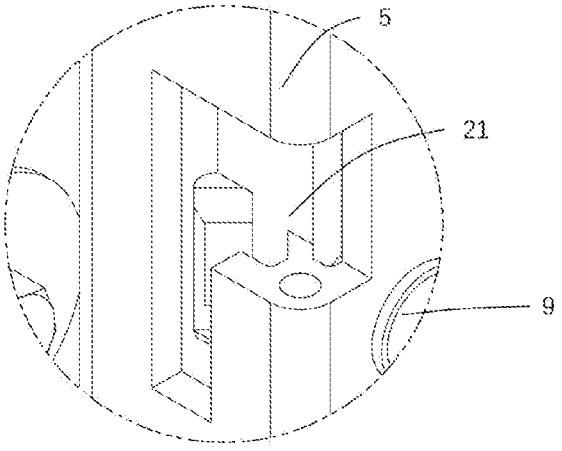

FIGS. 4A and 4B show detailed views of a portion A in FIG. 1, wherein the longitudinal beam 5 and the adapter plate 7 are illustrated in FIG. 4A, and only the longitudinal beam 5 is illustrated in FIG. 4B and the adapter plate 7 isn't illustrated in FIG. 4B. A complete cross-section of the beam 5 outside a region of the notch 21 is illustrated in FIG. 4D. The longitudinal beam 5 may have a plurality of longitudinally extending chambers, one of which 25 may form a guide groove through the notch 21, as the socket element for the plug element 23, and another chamber 26 may be used to receive a nut 27 of a locking device 9 to be described later (see FIG. 4E).

Figure 5:
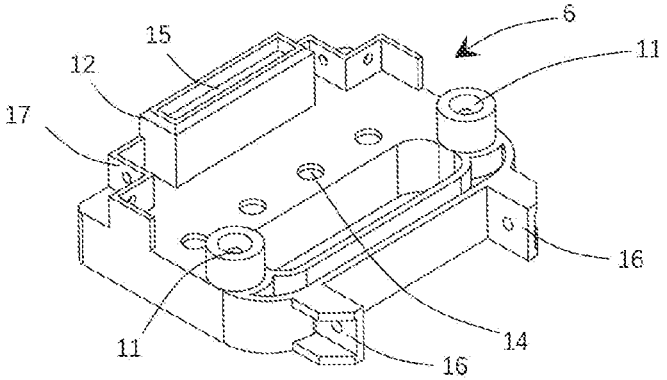
FIG. 5 is a perspective view of a support base of a mounting device of the BSA system of FIG. 1.

The mounting frame 4 may include an upper connecting strip 8. The connecting strip 8 may connect the two longitudinal beams 5 to each other at upper ends of the two longitudinal beams 5. The connecting strip 8 may be used for connecting with a clamping device (not shown), so as to connect the BSA 1 with a pole (not shown) above by means of the connecting strip 8 and the clamping device. The support base 6 may connect the two longitudinal beams 5 to each other at lower ends of the two longitudinal beams 5. To this end, the support base 6 may have an upright web 17 (see FIG. 5), and may be connected to the two longitudinal beams 5 by means of screws, for example. The support base 6 may be used for connecting with a clamping device (not shown) so as to connect the BSA 1 with the pole below by means of the support base 6 and the clamping device. To this end, the support base 6 may have a joint 16 extending from the body (see FIG. 5), which is configured for connecting with the clamping device.

Figure 4C:
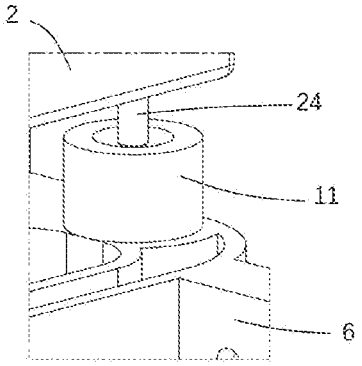
Figure 4D:
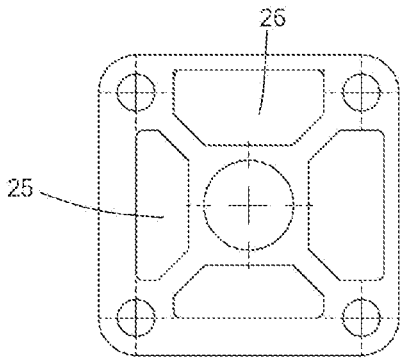

The mounting device 3 may include a pin-hole connection as shown in FIG. 4C. FIG. 4C is a detailed view of a portion B of FIG. 2. The pin-hole connection includes a pin 24 and a hole 11, wherein one of the pin and the hole is assigned to the RRU 2 and the other of the pin and the hole is assigned to the support base 6. In the first position, the pin and the hole are separated from each other, and in the second position, the pin and the hole are engaged with each other. In the shown embodiment, the support base 6 has the hole 11 and the RRU 2 has the pin 24. In order to better guide the pin 24, the hole 11 may have a conical surface. In some embodiments, the plug arrangement and the pin-hole connection may be configured to linearly and translationally guide the RRU 2 between the first position and the second position.

Figure 4E:
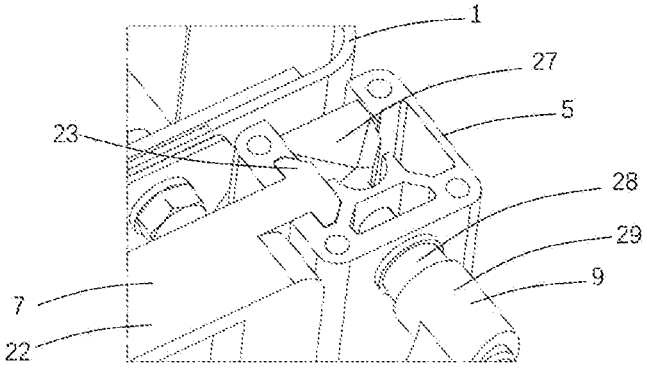

The mounting device 3 may include a locking device 9 configured to lock the RRU 2 on the BSA 1 in the second position, for example, lock it on the longitudinal beams 5 of the mounting frame 4 fixed to the BSA 1. Each longitudinal beam 5 may be provided with a locking device 9, which may include a nut 27 received in the longitudinal beam 5 in a rotation-resistant manner, a screw rod 28 engaged with the nut, and a cylindrical grip 29 for rotating the screw rod. The nut 27 and the plug element 23 associated with the longitudinal beam may have matched inclined surfaces. FIG. 4E is a partial cross-sectional view of the BSA system of FIG. 1 in a region of the notch 21, and details of the locking device 9 may be seen in FIG. 4E. By rotating the grip 29 in a direction, the screw rod 28 rotates together with the grip 29 in this direction, and the nut 27 can be moved on the screw rod 28 toward the plug member 23 and press the plug member 23. By rotating the grip 29 in an opposite direction, the screw rod 28 rotates together with the grip 29 in the opposite direction, and the nut 27 can be moved away from the plug member 23 on the screw rod 28 and release the plug member 23.

The support base 6 may have a plurality of receiving openings 14 for mounting RF connectors 13. In a mounting process of the RRU 2, RF connectors of the RRU 2 can be plugged in a blind manner and electrically connected with the RF connectors 13. For example, the RF connectors may be 4.3-10 connectors, 2.2-5 connectors, DIN 7/16 connectors or the like. The connectors may benefit from the ability to float axially and radially. For example, U.S. Pat. No. 9,570,849 reveals connectors with such float ability.

Figure 7:
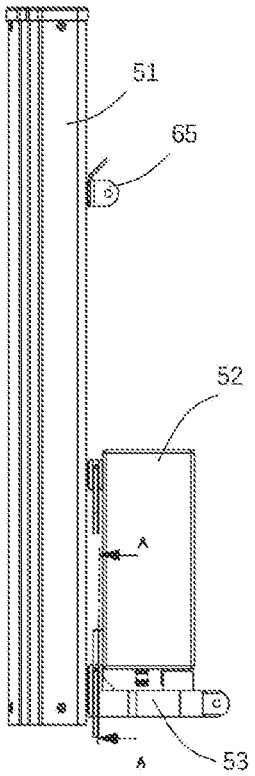
FIGS. 7 and 8 are a side view and an exploded view of a BSA system according to another embodiment of the present invention.
Figure 8:
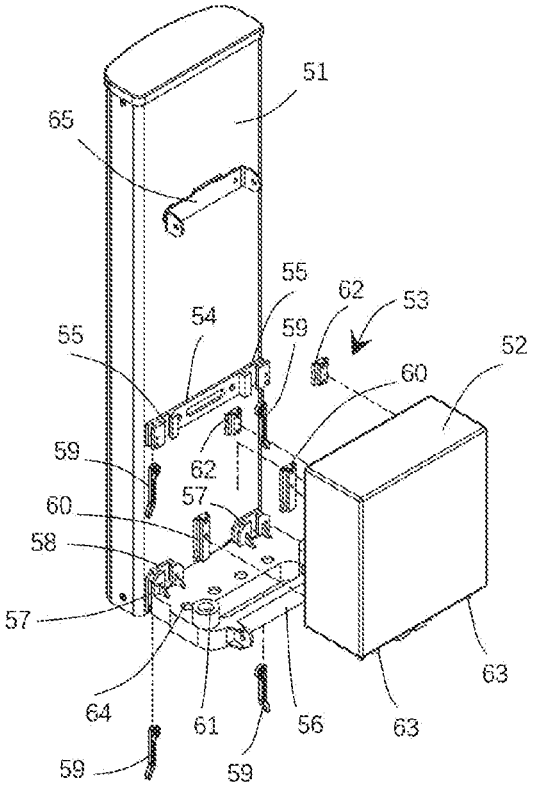
Figure 9:
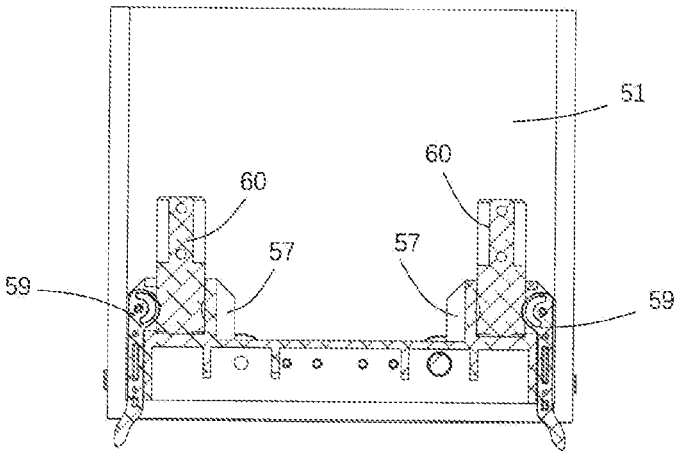
FIG. 9 is a partial sectional view along a section line A-A in FIG. 7.

Next, a BSA system according to a second embodiment of the present invention will be introduced with references to FIGS. 7 to 9, wherein FIG. 7 is a side view of the BSA system according to the second embodiment in a mounted state of a RRU, FIG. 8 is an exploded view of the BSA system of FIG. 7, and FIG. 9 is a partial cross-sectional view along a section line A-A in FIG. 7.

The BSA system includes a BSA 51 and the RRU 52, wherein the RRU 52 may be mounted to the BSA 51 by means of a mounting device 53.

The mounting device 53 may include a support base 56 configured to be mounted to the BSA 51 and to support the RRU 52. The RRU 52 can move between a first position and a second position in an unlocked state. For example, it can move linearly in a longitudinal direction of the BSA 51. The support base 56 may have a plurality of receiving openings 64 for receiving RF connectors.

The mounting device 53 may include two support elements 60 that are parallel to each other and are configured to be mounted to the RRU 52 and movable together with the RRU 52 between the first position, in which the support elements 60 are lifted from the support base 56, and the second position, in which the support elements 60 are supported on the support base 56, in a mounted state of the support elements 60 to the RRU 52. The shown support element s 60 may be configured as plug strips, which may have a T-shaped cross-section, for example. The support base 56 may have two seats 57, and each seat may have a guide groove 58. The seats 57 may be integral parts of the support base 56 or may be separate parts and fixed to the support base 56. The guide grooves 58 may extend in a longitudinal direction of the BSA 51 in a mounted state of the support base 56 to the BSA 51. In the first position, the support elements 60 as the plug strips and the guide grooves 58 are separated from each other, and in the second position, the support elements 60 are engaged with the guide grooves 58 and supported on the support base 56.

The mounting device 53 may include a plug arrangement, which may include a plug element and a socket element, one of which is configured to be mounted to the BSA, and the other of which is configured to be mounted to the RRU. In the second embodiment, the mounting device 53 may include a mounting strip 54 to be transversely mounted to the BSA 51 and may have two parallel guide grooves 55 spaced apart from each other as the socket elements. The guide grooves 55 may extend in a longitudinal direction of the BSA 51 when the mounting strip 54 is mounted to the BSA 51. The mounting device 53 may include two parallel plug strips configured to be mounted to the RRU 52 as the plug elements 62.

The mounting device 53 may include a connecting strip 65, which is configured to be mounted to the BSA 51 and to mount the BSA above to a pole (not shown) by means of a clamping device (not shown) connected with the connecting strip 65. The support base 56 may be connected with a clamping device (not shown), so as to connect the BSA 51 with the pole below by means of the support base and the clamping device.

In the second embodiment, the mounting device 53 may include a pin-hole connection, which may include a pin 63 and a hole 61. The pin-hole connection may be configured identically or similarly to that in the first embodiment.

The guide grooves 55, 58 may be provided with respective locking devices 59. The locking devices may be configured to lock the plug strips plugged into the guide grooves. The locking devices 59 may each have an elastic portion, which can press the plug strip in a locking position and release the plug strip in a releasing position. To this end, the plug strip may have a recess, and the elastic portion may enter into the recess in the locking position and leave the recess in the releasing position. FIG. 9 shows two locking devices 59 for locking the support elements 60 in the guide grooves 58 of the seats 57. For the other two locking devices 59 for locking the plug elements 62 in the guide grooves 55 of the mounting strip 54, the situation may be the same or similar. Additionally, or alternatively thereto, the locking device 59 may be mounted on an elastic split pin. Thus, it is possible that the locking device may have double elasticities.

Figure 10:
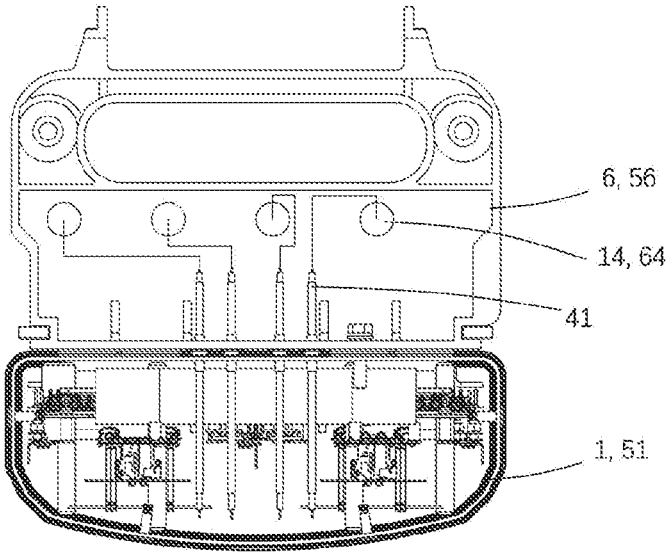
FIGS. 10 and 11 are a schematic view and a partial cross-sectional view of a circuit according to an embodiment of the present invention.
Figure 11:
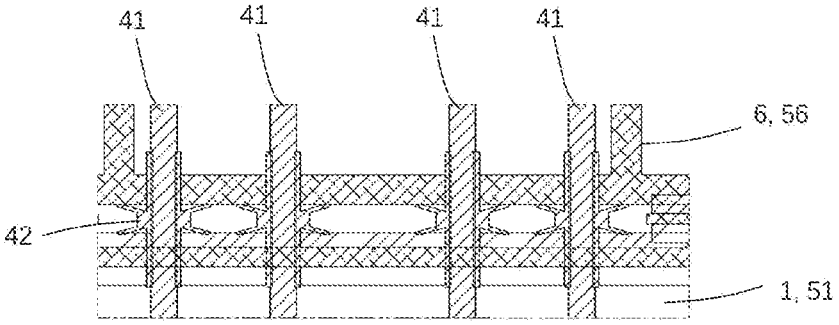

FIG. 10 is a schematic view of a circuit according to an embodiment of the invention, which may be applied to the above two embodiments, wherein the BSA system is viewed from the bottom in FIG. 10, and an end cover of the BSA 1, 51 and a cover of the support base 6, 56 are removed, so that cables 41 of the circuit may be observed. These cables 41 may be guided from the inside of the BSA 1, 51 through a wall of a radome of the BSA into a bottom chamber of the support base 6, 56, and may be electrically connected with RF connectors arranged in the receiving openings 14, 64. To seal the cables 41, sealing elements 42 may be provided for them, and the sealing elements may be placed onto the cables 41 and may be compressed between the BSA and the RRU. FIG. 11 is a partial sectional view illustrating the cables 41 and the sealing elements 42.

It will be understood that, the terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprise" and "include" (and variants thereof), when used in this specification, specify the presence of stated operations, elements, and/or components, but do not preclude the presence or addition of one or more other operations, elements, components, and/or groups thereof. As used herein, the term "and/or" includes any and all combinations of one or more of the associated listed items. Like reference numbers signify like elements throughout the description of the figures.

The thicknesses of elements in the drawings may be exaggerated for the sake of clarity. Further, it will be understood that when an element is referred to as being "on," "coupled to" or "connected to" another element, the element may be formed directly on, coupled to or connected to the other element, or there may be one or more intervening elements therebetween. In contrast, terms such as "directly on," "directly coupled to" and "directly connected to." when used herein, indicate that no intervening elements are present. Other words used to describe the relationship between elements should be interpreted in a like fashion (i.e., "between" versus "directly between", "attached" versus "directly attached," "adjacent" versus "directly adjacent", etc.).

Terms such as "top," "bottom," "upper," "lower." "above," "below," and the like are used herein to describe the relationship of one element, layer or region to another element, layer or region as illustrated in the figures. It will be understood that these terms are intended to encompass different orientations of the device in addition to the orientation depicted in the figures.

It will be understood that, although the terms "first," "second," etc. may be used herein to describe various elements, these elements should not be limited by these terms. These terms are only used to distinguish one element from another. Thus, a first element could be termed a second element without departing from the teachings of the inventive concept.

It will also be appreciated that all example embodiments disclosed herein can be combined in any way.

Finally, it is to be noted that, the above-described embodiments are merely for understanding the present invention but not constitute a limit on the protection scope of the present invention. For those skilled in the art, modifications may be made on the basis of the above-described embodiments, and these modifications do not depart from the protection scope of the present invention.

What is claimed is:

1. A mounting device for mounting a remote radio unit to a base station antenna, the mounting device including:

a support base configured to mount to the base station antenna and to support the remote radio unit;

a support element configured to mount to the remote radio unit and movable together with the remote radio unit between a first position, in which it is lifted from the support base, and a second position, in which it is supported on the support base, in a mounted state of the support element to the remote radio unit; and a plug arrangement including a plug element and a socket element, one of which is configured to mount to the base station antenna, and the other of which is configured to mount to the remote radio unit, wherein in the first position, the plug element and the socket element are separated from each other, and in the second position, the plug element and the socket element are engaged with each other;

wherein the support base has a plurality of RF connectors configured to electrically connect with the base station antenna and electrically connect with RF connectors of the remote radio unit in the second position.

2. The mounting device for mounting the remote radio unit to the base station antenna as recited in claim 1, wherein the mounting device includes a pin-hole connection that has a pin and a hole, wherein one of the pin and the hole is assigned to the remote radio unit, and the other of the pin and the hole is assigned to the support base.

3. The mounting device for mounting the remote radio unit to the base station antenna as recited in claim 2, wherein the plug arrangement and the pin-hole connection are configured to linearly and translationally guide the remote radio unit between the first position and the second position.

4. The mounting device for mounting the remote radio unit to the base station antenna as recited in claim 1, wherein the plug element and the socket element have complementary cross sections.

5. The mounting device for mounting the remote radio unit to the base station antenna as recited in claim 1, wherein the mounting device includes a mounting frame that is configured to be mounted to the base station antenna and includes two longitudinal beams that are parallel to each other, and each longitudinal beam has a notch and a guide groove as the socket element, and the guide groove extends along a longitudinal direction of the longitudinal beam, wherein the plug arrangement further includes a second plug element, and wherein the plug elements can be brought into the respective guide grooves through the respective notches in the first position and then can move along the respective guide grooves into the second position.

6. The mounting device for mounting the remote radio unit to the base station antenna as recited in claim 5, wherein the mounting device includes a first adapter plate having the two plug elements, and the first adapter plate is configured to be mounted to the remote radio unit.

7. The mounting device for mounting the remote radio unit to the base station antenna as recited in claim 5, wherein each longitudinal beam is provided with a locking device, which includes a nut received in the longitudinal beam in a rotation-resistant manner, a screw rod engaged with the nut, and a grip for rotating the screw rod, and the nut and the plug element associated with the longitudinal beam have matched inclined planes.

8. The mounting device for mounting the remote radio unit to the base station antenna as recited in claim 1, wherein the support base has a receptacle (12), and the support element can be supported on the receptacle in the second position.

9. The mounting device for mounting the remote radio unit to the base station antenna as recited in claim 8, wherein the receptacle has a groove (15) extending laterally, and the support element is supported and received in the groove in the second position.

10. The mounting device for mounting the remote radio unit to the base station antenna as recited in claim 9, wherein the support element is configured as a second adapter plate that has a body for planar abutting on the remote radio unit and fixed on the remote radio unit and a supporting section extending from the body, wherein the supporting section is supported and received in the groove in the second position.

11. The mounting device for mounting the remote radio unit to the base station antenna as recited in claim 1, wherein the support element is configured as a second adapter plate that includes a body for planar abutting on the remote radio unit and fixed on the remote radio unit and a support section extending from the body.

12. The mounting device for mounting the remote radio unit to the base station antenna as recited in claim 1, wherein the mounting device includes a mounting strip transversely mounted to the base station antenna and having two parallel first guide grooves spaced apart from each other as the socket elements, which extend in a longitudinal direction of the base station antenna in a mounted state of the mounting strip to the base station antenna.

13. The mounting device for mounting the remote radio unit to the base station antenna as recited in claim 12, wherein the mounting device includes two first plug strips parallel to each other and configured to be mounted to the remote radio unit as the plug elements.

14. The mounting device for mounting the remote radio unit to the antenna of the base station as recited in claim 13, wherein each first guide groove is provided with a first locking device that is configured to lock the first plug strip plugged into the first guide groove.

15. The mounting device for mounting the remote radio unit to the base station antenna as recited in claim 1, wherein, the support base has two second guide grooves which are parallel to each other and are spaced apart from each other, and the second guide grooves extend in a longitudinal direction of the base station antenna when the support base is mounted to the base station antenna;

the mounting device includes two parallel second plug strips to be mounted to the remote radio unit as the support elements; and wherein, in the first position, the second plug strips and the second guide grooves are separated from each other, and in the second position, the second plug strips are engaged with the second guide grooves and are supported on the support base.

16. The mounting device for mounting the remote radio unit to the base station antenna as recited in claim 1, wherein the mounting device includes a locking device configured to lock the remote radio unit on the base station antenna in the second position.

17. A base station antenna system including a base station antenna and a remote radio unit, wherein the base station antenna system further includes the mounting device for mounting the remote radio unit to the base station antenna as recited in claim 1.

18. A mounting device for mounting a remote radio unit to a base station antenna, the mounting device including:

a support base configured to mount to the base station antenna and to support the remote radio unit;

a support element configured to mount to the remote radio unit and movable together with the remote radio unit between a first position, in which it is lifted from the support base, and a second position, in which it is supported on the support base, in a mounted state of the support element to the remote radio unit; and a plug arrangement including a plug element and a socket element, one of which is configured to mount to the base station antenna, and the other of which is configured to mount to the remote radio unit, wherein in the first position, the plug element and the socket element are separated from each other, and in the second position, the plug element and the socket element are engaged with each other;

wherein the support base has two second guide grooves which are parallel to each other and are spaced apart from each other, and the second guide grooves extend in a longitudinal direction of the base station antenna when the support base is mounted to the base station antenna;

the mounting device includes two parallel second plug strips to be mounted to the remote radio unit as the support elements; and wherein, in the first position, the second plug strips and the second guide grooves are separated from each other, and in the second position, the second plug strips are engaged with the second guide grooves and are supported on the support base.

* * * * *